US007823943B2

(12) United States Patent
Borg

(10) Patent No.: US 7,823,943 B2
(45) Date of Patent: Nov. 2, 2010

(54) MULTIPLE CONTAINER CARRIER

(75) Inventor: Zakary James Borg, Eugene, OR (US)

(73) Assignee: Oregon Precision Industries, Inc., Eugene, OR (US)

( * ) Notice: Subject to any disclaimer, the term of this patent is extended or adjusted under 35 U.S.C. 154(b) by 1010 days.

(21) Appl. No.: 11/476,366

(22) Filed: Jun. 27, 2006

(65) Prior Publication Data

US 2007/0296231 A1 Dec. 27, 2007

(51) Int. Cl.
*B66C 1/10* (2006.01)

(52) U.S. Cl. ..... 294/87.2

(58) Field of Classification Search ..... 294/87.2; 206/150, 153

See application file for complete search history.

(56) References Cited

U.S. PATENT DOCUMENTS 3,269,530 A * 8/1966 Wanderer ..... 294/87.2
3,633,962 A 1/1972 Erickson
4,523,677 A * 6/1985 Schurmann ..... 294/87.2
5,346,271 A * 9/1994 Erickson ..... 294/87.2
5,480,204 A * 1/1996 Erickson ..... 294/87.2
RE35,288 E * 7/1996 Borg ..... 294/87.2
5,806,667 A * 9/1998 Marco ..... 206/150
D405,687 S * 2/1999 Borg ..... D9/752
6,129,397 A 10/2000 Borg
6,789,828 B1 * 9/2004 Borg ..... 294/87.2
7,108,128 B2 9/2006 Borg
7,377,382 B2 * 5/2008 Borg et al. ..... 206/150

* cited by examiner

*Primary Examiner*—Paul T Chin
(74) *Attorney, Agent, or Firm*—Chernoff, Vilhauer, McClung & Stenzel

(57) ABSTRACT

Improvements in integral carriers for carrying multiple containers by their necks are disclosed, the improvements comprising annular neck-engaging structures having circumferential ribs oriented on an inward bias forming an angle relative to horizontal from about 45° to about 65° that permits nesting of the carriers, and a centrally disposed longitudinal handle with an attachment configuration that promotes a balanced distribution of weight for ease in carrying and handling.

8 Claims, 4 Drawing Sheets

MULTIPLE CONTAINER CARRIER

BACKGROUND OF THE INVENTION

Six-pack or multiple bottle carriers which hold bottles or containers by their necks to allow them to be carried are well known. The bottles typically have labels to advertise their contents. A common type of commercially available prior art carrier is fabricated from thin gauge sheets of plastic. The thin planar sheet is die-cut to provide holes for engaging the necks of the containers and holes for grasping the carrier, and is thermo-formed into a three dimensional shape to provide structural integrity to the carrier. There are several problems with this carrier. First, the thermo-formed plastic sheet shrouds the container, obscuring visibility of the product and product labels. Second, the thin gauge of the plastic material makes the carrier uncomfortable to carry. Further, the thin gauge material requires a substantial amount of structural surface area to support the containers. This tends to further hide the product in the containers and advertising on the labels.

Another carrier design is disclosed in U.S. Pat. No. 3,633,962. It has keyhole-shaped neck retainers and sharp edges on both the neck retainers and the finger holes. This carrier is also uncomfortable to carry due to its sharp edges. In addition, the rigid keyhole-shaped neck retainers are difficult to fit over the neck flanges of the containers, and likewise it is difficult to remove the containers from the carrier due to the rigid key hole-shaped neck retainers.

Commonly owned U.S. Pat. No. 6,129,397 discloses a six pack carrier design that overcomes the aforementioned drawbacks of the prior art. However, that carrier design allows the outboard containers to sag a bit due to inadequate support for them when the loaded carrier is lifted by the carrier's handholds.

There is a continuing need for a carrier that is comfortable to carry, allows for excellent visibility of the product in the containers and the labels on the containers, allows for easy application and removal of the containers from the carrier, provides good balance in carrying and handling containers, and that readily lends itself to nested stacking of multiple carriers for compact shipping and ease of loading into and handling by high speed mechanical applicators.

BRIEF SUMMARY OF THE INVENTION

There are essentially two aspects to the present invention.

In a first aspect, there is provided an improvement in multiple-container carriers having annular neck-engaging structures, the improvement comprising inwardly biased circumferential ribs for the neck-engaging structures.

In a second aspect, there is provided a multiple-container carrier comprising a substantially planar web defining a plurality of annular neck-engaging structures integral with the web and arranged in two groups on either side of a centrally disposed longitudinal and flexible handle attached to the neck-engaging structures at four generally outboard points. Each of the neck-engaging structures has a respective inwardly biased circumferential rib and a plurality of flanges projecting inwardly from the circumferential rib for releasably engaging the necks of the containers. Each flange is provided with a supporting rib that bridges the inwardly biased circumferential ridge and the flange.

DETAILED DESCRIPTION OF PREFERRED EMBODIMENT

Figure 6:
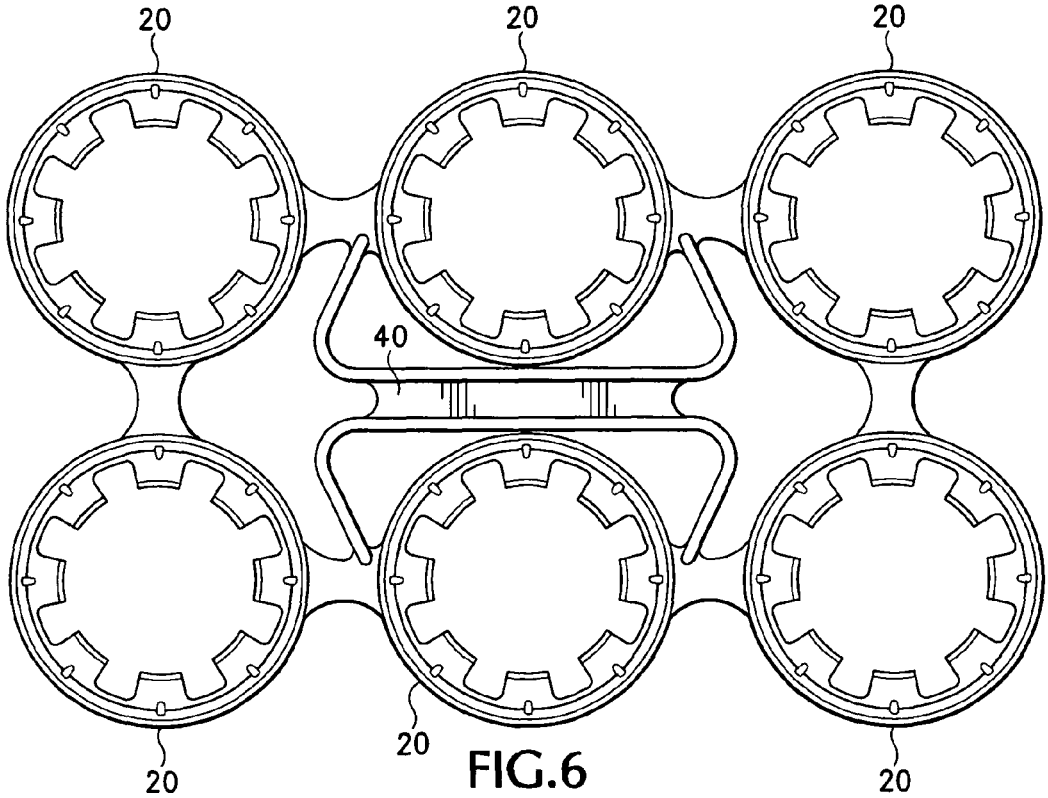
FIG. 6 is a plan view of another exemplary carrier of the invention.

Referring to the drawings, wherein like numerals generally refer to the same elements, there is shown in FIGS. 1-4 and 6 an integral carrier 10 for carrying multiple containers. Carrier 10 has a web 12 that is substantially planar. A plurality of identical annular neck-engaging structures 20 are integral with the web 12 and are arranged in two groups of equal number substantially parallel to each other. Although FIGS. 1-4 depict two rows of four neck-engaging structures and FIG. 6 depicts two rows of three neck-engaging structures, it is to be understood that the invention contemplates two parallel rows of equal numbers of neck-engaging structures anywhere from two to three to four and even to five, for a respective total of four, six, eight and ten neck-engaging structures.

Figure 5:
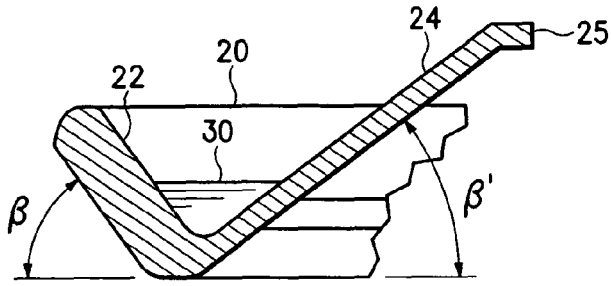
FIG. 5 is a sectional view taken through the plane AA of FIG. 4.

Each neck-engaging structure 20 has a respective inwardly biased circumferential rib 22, seen most clearly in FIG. 5, with the bias orienting at an angle β relative to horizontal. In a preferred embodiment, β ranges from about 45° to about 65°, most preferably about 55°. Each neck-engaging structure 20 also has a plurality of flanges 24 comprising sections of a truncated cone projecting inwardly from circumferential rib 22 for releasably engaging the necks 26 of containers 28. The flanges 24 are oriented upwardly at a uniform angle β', relative to horizontal. In a preferred embodiment, β' ranges from about 35° to about 40°, most preferably about 37°. The inner edges 25 of flanges 24 form a circle and engage the necks 26 of the containers 28, allowing carrier 10 to secure and support the containers.

Bridging each of the flanges 24 and circumferential rib 22 are support ribs 30, which add dimensional support to the neck-engaging structures 20 of the carrier.

Virtually any handle design will work with the inwardly biased circumferential ribs of multiple neck-engaging structures, including, but not limited to, straps of the type disclosed in U.S. Pat. No. 6,789,828, finger loops of the type disclosed in copending U.S. application Ser. No. 11/207,519, rotating bales of the type disclosed in U.S. application Ser. No. 11/102,362 and U.S. Pat. No. 6,394,517 and mere finger holes of the type disclosed in U.S. Pat. Nos. 6,129,397 and 6,715,810, all of which are commonly owned by the assignee of this application, and the disclosures of all of which are incorporated herein by reference.

In a preferred embodiment, the handle is a centrally and axially disposed longitudinal handle 40 may be located between the two rows of neck-engaging structures. Handle 40 preferably comprises two external radiused ribs 45 integral with a flat belt portion 46 between ribs 45, and is attached to web 12 by stringers 42 at four generally outboard points 44, and angled back toward the center of the carrier at substantially less than 90°, preferably about 65°, relative to the longitudinal axis of the handle. Such a back angle arrangement allows stringers 42 to rotate torsionally, thereby permitting handle 40 to rise above the plane of web 12 when the loaded carrier is carried. When the carrier is not being lifted or carried, the torsional tension on stringers 42 is released, and handle 40 returns to the same plane as web 12.

The carrier is manufactured using high pressure injection molding of heated and liquified polymer into a three-dimensional cavity, and is preferably made of a flexible material such as a polyolefin. In a most preferred embodiment, the polyolefin is high density polyethylene (HDPE) that has a tensile strength from about 4000 to about 5000 psi, and a brittleness temperature of less than −30° C. This material is readily recyclable, in contrast to the material used to make conventional die-cut thermo-formed carriers.

Figure 7:
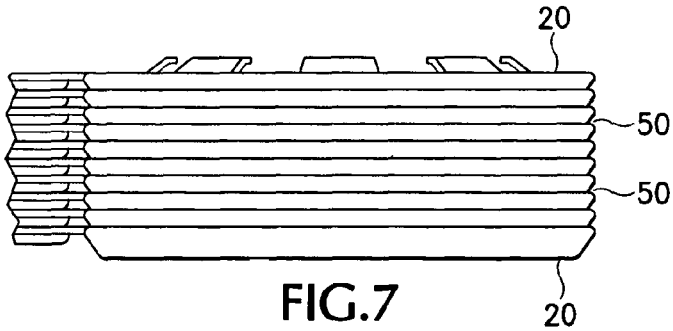
FIG. 7 is a side view of a nested stack of exemplary carriers of the invention.

The carrier of the invention concentrates structure into three-dimensional ribs, thereby reducing the surface area required to support containers. At the same time, this minimal surface area provides for a quality appearance while utilizing less material. The carrier is essentially planar and so does not obscure the container or product therein or labels, but instead provides high product and label visibility. The planar configuration of the carrier coupled with its uniformly inwardly biased neck-engaging structures allow multiple carriers to be nested together, one on top of another. This feature permits compact packaging for shipment of large quantities of carriers, and permits multiple carriers to be loaded, for example, into a magazine of a high speed mechanical applicator that applies the carriers to sets of multiple containers. This same feature permits quick and easy dislodging of single carriers from a nested bundle of carriers by virtue of the small gap 50 along and between the peripheries of adjacent carriers, best seen in FIG. 7.

In addition, the centrally disposed handle provides outboard points of attachment for superior comfort for lifting and carrying the carrier, and superior balance for carrying and handling containers. The carrier also provides superior release of the containers. The circumferential ribs around the angled, thin conical flanges provide support for the containers. The thin flanges easily flex to allow the containers to be removed by either lifting the carrier relative to the container or pulling the container down and away from the carrier.

EXAMPLE

Carriers of substantially the same designs shown in the drawings were fabricated by injection molding from HDPE having a specific gravity of 0.962, with a tensile strength of about 4800 psi (33 mPa), a flexural strength of about 7000 psi (48 mPa) and a brittleness temperature of approximately −30° C.

Figure 1:
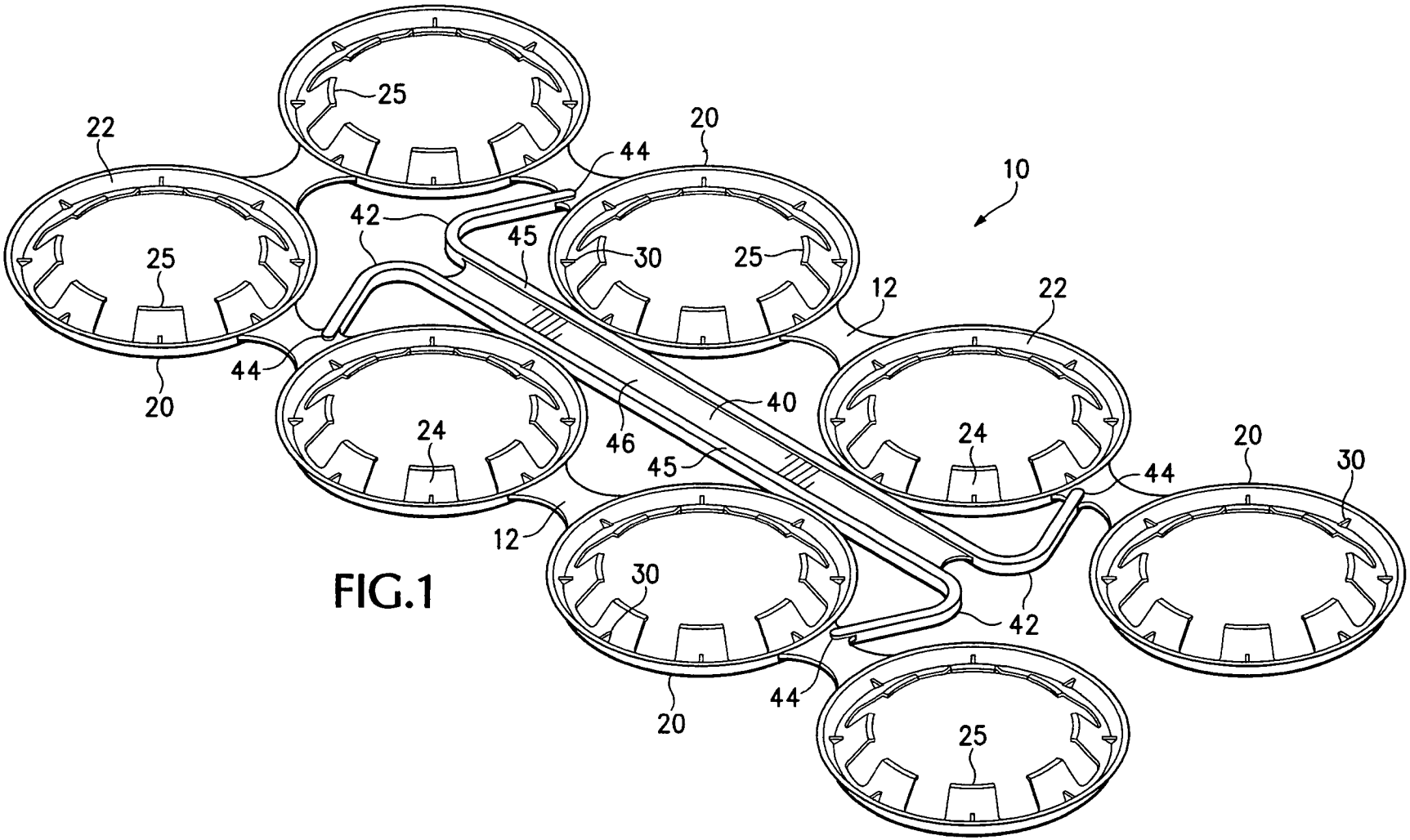
FIG. 1 is a perspective view of an exemplary carrier of the invention.
Figure 2:
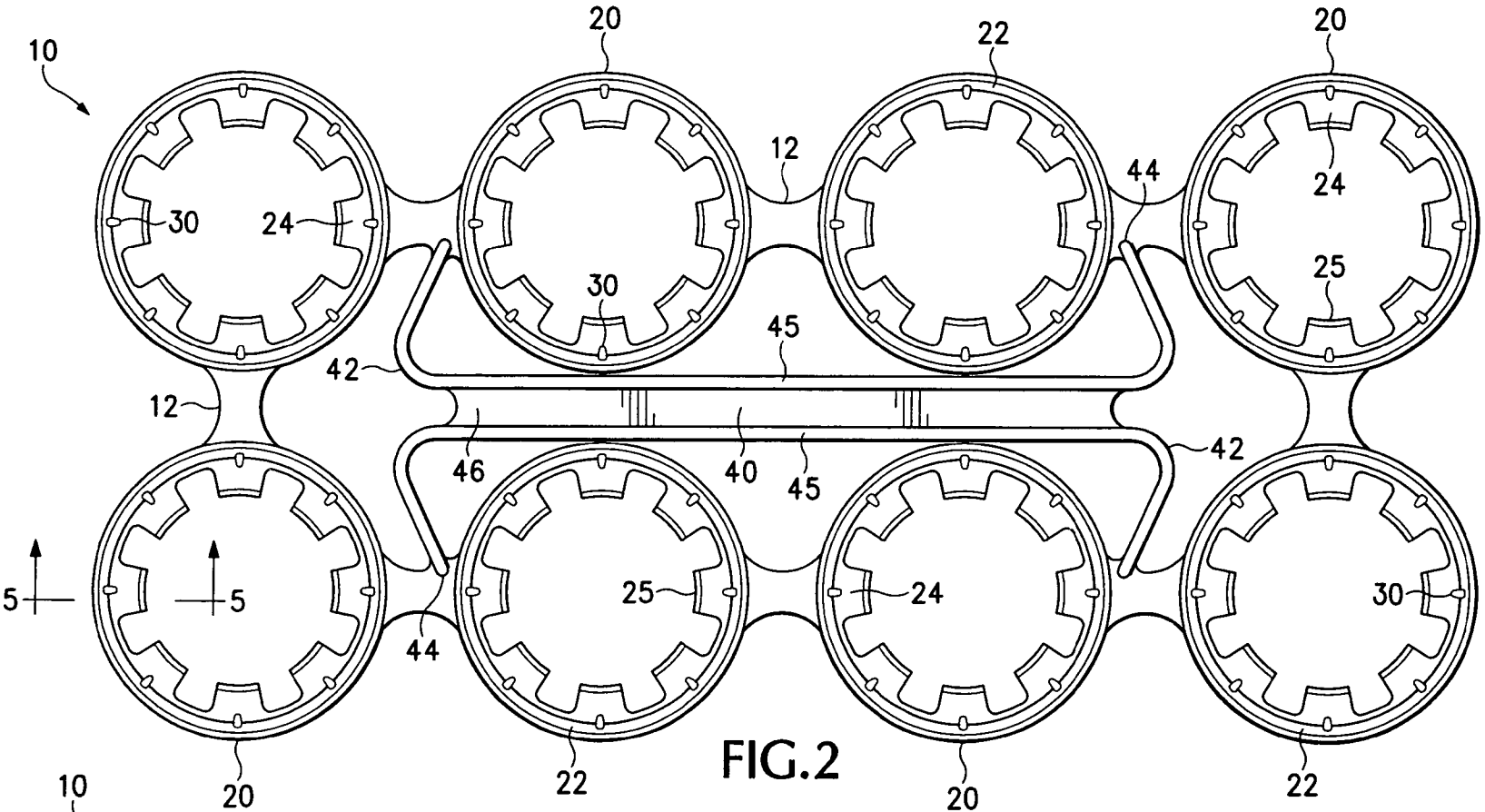
FIG. 2 is a plan view of the carrier of FIG. 1.
Figure 3:
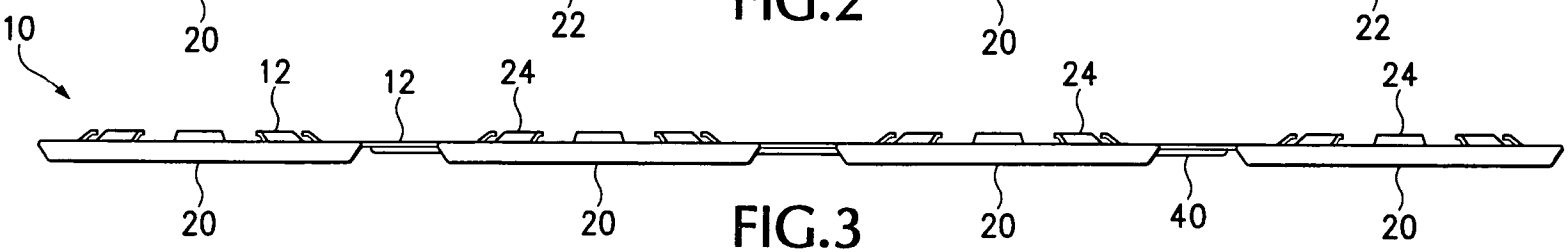
FIG. 3 is a side view of the carrier of FIG. 1.
Figure 4:
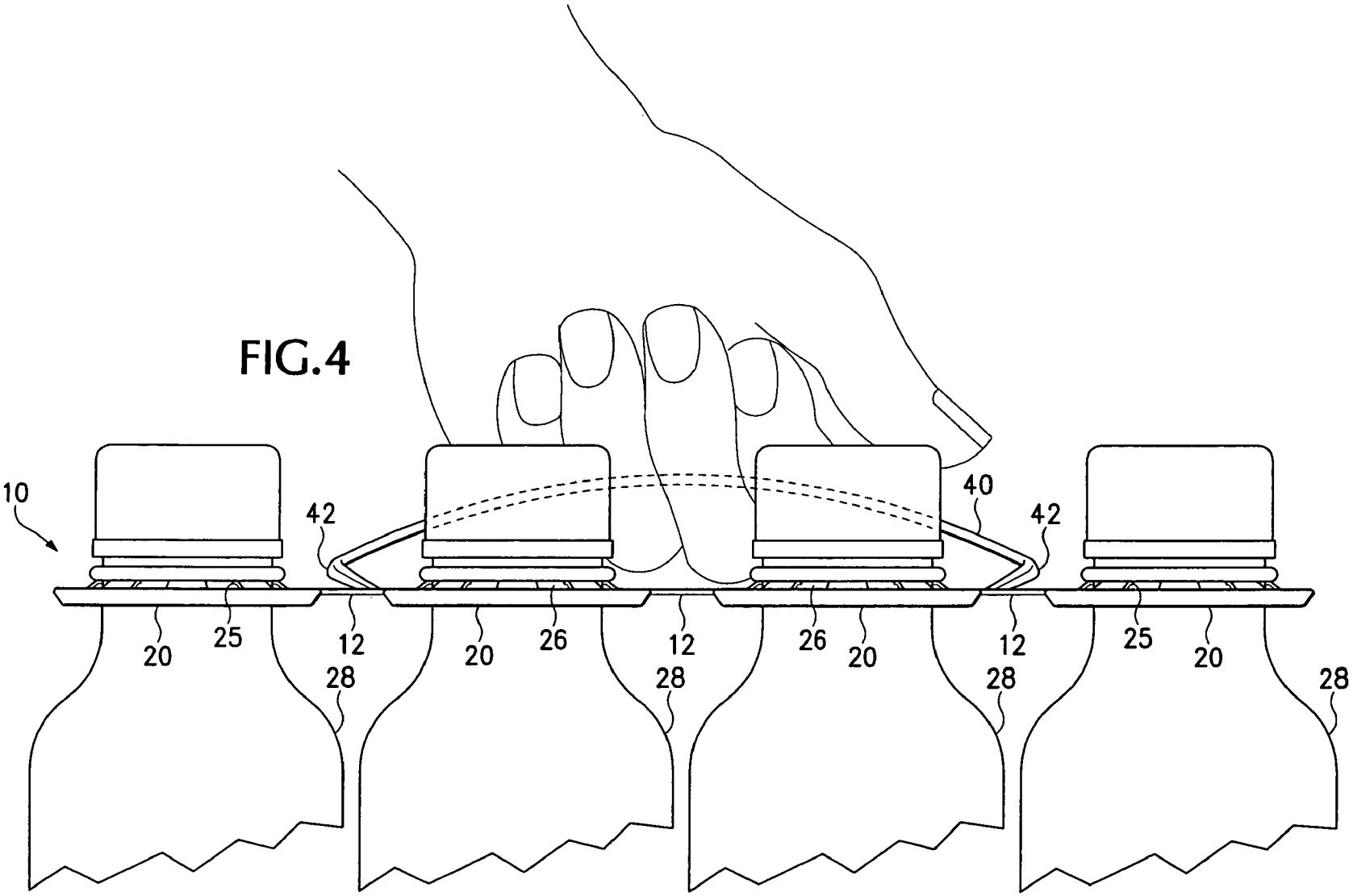
FIG. 4 is a side view of the carrier of FIG. 1 shown in place on multiple containers and in a carrying orientation.

The so-fabricated carriers were easily and quickly secured over the annular flanges of eight 12-ounce bottles by placing the neck-engaging structures 20 over the bottle necks/can tops and pushing them down until the flanges 24 of the neck-engaging structures engaged the annular flanges 26 on the necks of containers 28 as illustrated in FIG. 4. The carrier secured and supported the containers, yet readily disengaged by simply pulling the containers downward and away from the carrier.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

The invention claimed is:

1. In an integrally molded carrier (10) for carrying multiple containers by their necks, comprising:

(a) a substantially planar web (12) having a top surface and a bottom surface, said web (12) defining two parallel rows of annular neck-engaging structures (20); and (b) each of said neck-engaging structures (20) having a respective circumferential rib (22) and a plurality of flanges (24) projecting inwardly from said circumferential rib for releasably engaging the necks of the containers the improvement comprising orienting the entirety of each of said respective circumferential ribs (22) on an inward bias forming a uniform angle (β) relative to horizontal of from about 45° to about 65°.

2. The carrier of claim 1 wherein said angle (β) is about 55°.

3. The carrier of claim 2 wherein said plurality of flanges (24) are oriented upwardly at a second substantially uniform angle (β') relative to horizontal.

4. The carrier of claim 3 wherein said second uniform angle (β') is from about 35° to about 40°.

5. The carrier of claim 4 wherein said plurality of flanges are provided with bridging ribs (30) between each of said flanges and each of said circumferential ribs.

6. The carrier of claim 5 formed of a flexible material.

7. The carrier of claim 6 wherein said flexible material is high density polyethylene.

8. The carrier of claim 1 wherein said two parallel rows of annular neck-engaging structures are selected from the group consisting of two rows of four and two rows of three.

* * * * *